9/7/76 OR 3,979,755

United States Patent [19]

Sandoz et al.

[11] 3,979,755

[45] Sept. 7, 1976

[54] ROTATING LENS ANTENNA SEEKER-HEAD

[75] Inventors: Roger W. Sandoz, Fairfield; Myron M. Rosenthal, Wayne, both of N.J.

[73] Assignee: The United States of America as represented by the Secretary of the Army, Washington, D.C.

[22] Filed: Dec. 17, 1974

[21] Appl. No.: 533,563

[52] U.S. Cl. ..... 343/754; 343/872

[51] Int. Cl.[2] ..... H01Q 19/08

[58] Field of Search ..... 343/754, 854, 705, 872

[56] References Cited

UNITED STATES PATENTS 3,226,721 12/1965 Gould ..... 343/754

*Primary Examiner*—Eli Lieberman

*Attorney, Agent, or Firm*—Nathan Edelberg; Robert P. Gibson; Freddie M. Bush

[57] ABSTRACT

A rotating lens antenna seeker-head provides conical scan capability for an antenna system while simultaneously providing a two axis scan capability by positioning rotating lens in front of a microwave antenna. A pair of rotatable lens are disposed in parallel across the beam front of the antenna system to refract the microwave beam away from the antenna boresight, providing variable scanning modes. The third wedge provides the conical scan pattern for the antenna regardless of the position of the two axis wedges.

5 Claims, 3 Drawing Figures

ROTATING LENS ANTENNA SEEKER-HEAD

DEDICATORY CLAUSE

The invention described herein may be manufactured, used, and licensed by or for the Government for governmental purposes without the payment to us of any royalties thereon.

BACKGROUND OF THE INVENTION

Prior art antenna systems employed gimbals to physically point the antenna in the desired direction. Some systems avoided pointing a single antenna by utilizing multiple feed horns or arrays which are electrically oriented in the position desired. In the gimbal system a disadvantage is the heavy load that is placed on the inner gimbal by the physical antenna and system structure. This load must be carried and positioned by the outer gimbals and motors, resulting in a physically cumbersome unit. In addition, problems of the second nutation for tracking incorporate design and feed problems. Multiple feed designs and electrically scan antennas are highly sophisticated, complex, and costly.

SUMMARY OF THE INVENTION

The rotating lens antenna seeker-head is a system wherein a first dielectric wedge is rotated within the plane of a microwave beam of energy to obtain a conical scan pattern from the beam. An additional pair of independently rotatable dielectric wedges are disposed in parallel with the first wedge and positioned to refract the microwave beam away from the antenna directional axis or boresight to a variable scan axis offset from the boresight axis.

An object of the rotating lens antenna seeker-head is to provide a two axis scan of a microwave antenna system while providing a conical scan capability simultaneously.

DESCRIPTION OF THE PREFERRED EMBODIMENT

Figure 1:
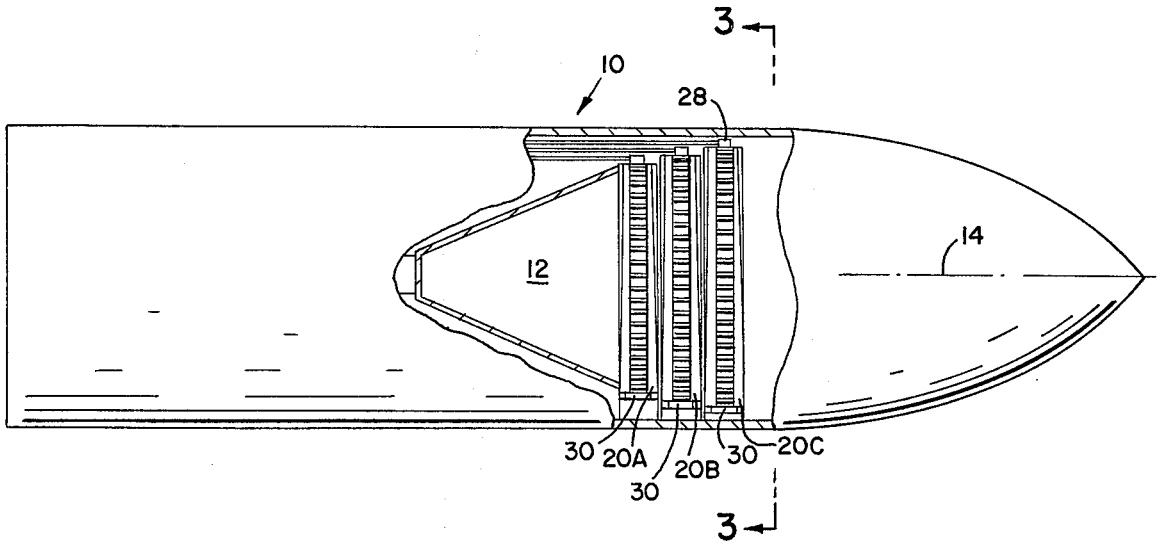
FIG. 1 is a diagrammatic view of the rotating lens antenna seeker-head embodied in the nose of a projectile, with extraneous support structure omitted.

In the conical scanning of a microwave beam the beam describes a cone whose axis coincides with the axis of the reflector. The antenna beam is offset from the boresight and rotates continuously. It is desirable during conical-scan tracking to allow the beam direction to be variable, broadening the range of the conical region being scanned. In FIG. 1 of the drawings a projectile 10 is disclosed wherein a rotating lens system allows the antenna beam to provide a two axis scan or rectangular coordinated scan while simultaneously providing a conical scan. In the preferred embodiment an antenna 12 is positioned so the boresight of the antenna is fixed with respect to the roll axis 14 of the vehicle. Dielectric wedges 20A, 20B, and 20C function as lenses and are disposed in parallel across the path of the beam from antenna 12 with the wedges being illuminated by the antenna beam. The dielectric wedges are independently rotatable to refract the beam away from the vehicle or projectile roll axis to achieve the desired scanning modes.

Figure 2:
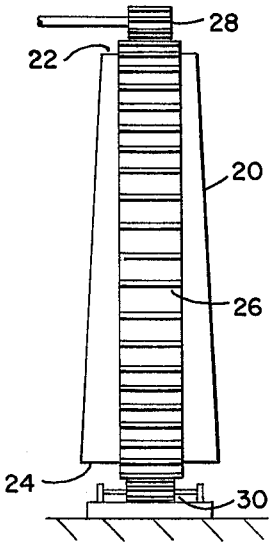
FIG. 2 is a side view of a typical wedge shaped lens.

As shown in FIG. 2 wedges 20 are thin or narrow along one edge 22 and are thick along the opposite edge 24. Because of their difference in thickness at microwave lengths between opposing edges 22 and 24, the antenna beam passing therethrough is moved toward the edge 24 of the wedge. Wedges 20A and 20C are individually controlled by position motors (not shown) which rotate the wedges in such a manner that the antenna beam can be pointed as desired. Wedge 20B provides the conical scan pattern during operation.

Figure 3:
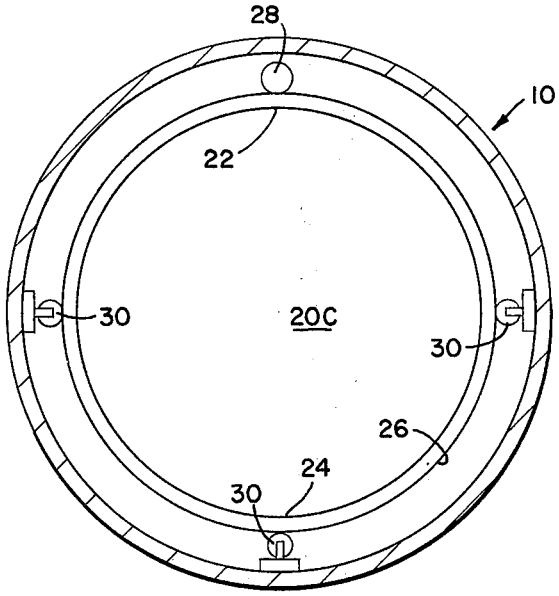
FIG. 3 is an end view taken along line 3—3 of FIG. 1, showing a typical wedge shaped lens with support rotors for rotating the lens.

Obviously, wedges 20 may all be programmed for continuous or periodic rotation to provide various modes of operation with the conical scan provided by wedge 20B. To this end FIGS. 2 and 3 disclose a simple means for rotating the wedges without interferring with the beam projected therethrough. A gear rack 26 is provided around the circumference of wedge 20 whereby a driving gear 28 drives the wheel. A driving motor and resolver (not shown) operate with each wedge in conjunction with the vehicle electronics to control or maintain the scan path. Idler supporting gears 30 positioned around the inner periphery of the vehicle or on support structure, maintains the position of respective wedges in the beam path. Obviously, various methods of supporting and rotating the wedges are available in the art and the above method is merely descriptive of one means. For example, a conical sleeve may support each wedge, one within another, around the antenna structure with the gearing and driving means located at the rear of the conical sleeve.

During scanning operation of the system, wedges 20A and 20C determine the axis along which the antenna beam is pointed. In the particular case where these wedges have identical slopes and with the wedges rotated 180° with respect to each other such that the thin edge of wedge 20A is adjacent the thick edge of wedge 20C, the antenna beam is offset from and projected substantially parallel to the roll axis 14 of the vehicle. Maintaining this relationship between these lenses while rotating lens 20B provides the offset conical scan for the vehicle antenna. Changing the orientation between lenses 20A and 20C to something less than 180° increases the beam divergence from the roll axis 14, with the divergence being greatest when the wedges are oriented alike, such as when the thin edges are aligned. Obviously, various degrees of beam direction and control can be provided by using wedge lenses having different slopes. Similarly, the wedges need not be flat but can be curved to conform to a contour such as that of the radome. However in such case the wavelengths of delay must be configured in the design.

Although a particular embodiment and form of this invention has been illustrated, it is apparent that various modifications and embodiments of the invention may be made by those skilled in the art without departing from the scope and spirit of the foregoing disclosure. For example the wedges need not be of a dielectric material but can be waveguide of various shapes. Typical microwave delay structures which will accomplish the action of this wedge include the artificial dielectric waveguide and waveguide lens. Accordingly, the scope of the invention should be limited only by the claims appended hereto.

We claim:

1. In a radar system wherein a beam of microwave energy is transmitted from an antenna through a radome, the improvement comprising: a plurality of rotatable lenses disposed in parallel within said radome between said antenna and said radome for redirecting microwave energy impinging thereon, said plurality of rotatable lenses are first, second, and third wedges disposed in respective parallel planes across the beam path of said antenna with said first wedge being positioned between said second and third wedges, said first wedge being constantly rotatable for providing a conical scan pattern, and said second and third wedges being rotatable to adjustably offset the antenna beam a predetermined distance from the antenna boresight.

2. In a radar system as set forth in claim 1 the further improvement wherein said wedges are dielectric to microwave energy, each of said wedges have first and second opposite edges that are respectively thick and thin, with flat surfaces therebetween, and said wedges are circular around the edges.

3. In a radar system as set forth in claim 1 the improvement wherein said second and third wedges are independently rotatable to adjustably refract the beam variable degrees away from the antenna boresight during said conical scan to provide plural scanning modes.

4. In a radar system as set forth in claim 3 the improvement wherein said second and third wedges have identical slopes for providing a minimum refraction displacement parallel with the antenna boresight when the wedges are positioned such that like edges are rotated 180° with respect to each other.

5. In a radar system as set forth in claim 3 wherein said second and third wedges have different slopes for providing said plural scanning modes.

* * * * *